United States Patent [19]

Cummins

[11] Patent Number: 4,724,286

[45] Date of Patent: Feb. 9, 1988

[54] ADAPTABLE ROTARY POWER CONTROL SWITCH

[75] Inventor: James P. Cummins, San Antonio, Tex.

[73] Assignee: Power Controls Corp., San Antonio, Tex.

[21] Appl. No.: 881,127

[22] Filed: Jul. 1, 1986

[51] Int. Cl.[4] ..... H01H 9/00; H01H 3/00; H01C 10/50

[52] U.S. Cl. ..... 200/4; 200/5 R; 200/6 R; 200/11 R; 200/18; 200/153 L; 200/293; 200/329; 338/200

[58] Field of Search ..... 200/1 R, 5 R, 4, 6 R, 200/6 B, 7, 11 R, 11 J, 11 D, 11 DA, 11 G, 11 K, 11 E, 11 EA, 14, 17 R, 18, 153 J, 153 L, 293, 329, 336, 337; 174/16 HS; 338/200, 215

[56] References Cited

U.S. PATENT DOCUMENTS 3,924,185 12/1975 Schwartz ..... 200/11 G X

*Primary Examiner*—J. R. Scott

*Attorney, Agent, or Firm*—Thomas E. Sisson

[57] ABSTRACT

A rotary power control unit is capable of functioning as many different switches. The power control unit includes a housing, a shaft-actuator assembly, a circuit board with a variable resistor, and a strap for containing these elements in the housing. The shaft-actuator assembly is rotatably attached to the floor of the housing, and passes through the circuit board and strap where it is connected to a control knob. The shaft is also fastened to a wiper shoe which rotates with the shaft and varies the resistance of the circuit. By interchanging shaft-actuator assemblies, and adding appropriate components to the circuit board, the rotary power control unit may take the form of:

a simple rotary control, a rotary control with full-on bypass, a simple push control, a three-way push control, or a tandem push control.

25 Claims, 23 Drawing Figures

ADAPTABLE ROTARY POWER CONTROL SWITCH

BACKGROUND OF THE INVENTION

1. Field of the Invention

The present invention relates to power control switches, and more particularly, to a rotary power control switch capable of performing many different functions.

2. Description of the Prior Art

Rotary power control switches are known in the prior art. Such devices are typically used in the home as dimmer switches for lights or motor controls for fans and the like. There are also industrial applications for such switches.

There are basically two types of switching potentiometers commercially available. These may be classified as the rotary type or the bush-button type. Rotary type switches are typically operated by rotating the control knob to switch on the power and then continuing to rotate the control knob until the desired setting is reached. Switches for lights tend to initially make electrical contact at high resistances to prevent a power surge in the bulbs, thus extending their lives; rotation of the control knob increases brightness. Switches for motors tend to initially provide full power to overcome inertia, and continued rotation lowers amperage.

Push-button switches are generally two types, push-pull or push-push (reciprocating). Once a desired level of power has been set, the unit may be activated by simply pushing or pulling the control knob. Both push-button and rotary type switches may be connected to provide three-way control as shown in U.S. Pat. No. 4,259,619, issued to Wall. Also, a full-on bypass may be provided to eliminate power loss in the full-on position.

The difficulty for manufacturers of such switches is the requirement that different housings, circuitry, and mechanical parts be used for each different type of switch. The cost of separate molds, circuit boards, and extra assembly lines can be exorbitant. It would therefore be desirable and advantageous to devise an adaptable rotary power control switch whose construction provides for interchangeability of parts, thus lessening the economical burdens on manufacturers who wish to produce a complete line of such switches.

SUMMARY OF THE INVENTION

Accordingly, the primary object of the present invention is to provide an adaptable rotary power control switch capable of receiving different types of control mechanisms.

Another object of the invention is to provide an adaptable control switch which can easily be converted from a simple rotary control to a push-push control.

Still another object of the invention is to facilitate use of such a control switch as either a single power control or as a three-way power control.

Yet another object of the invention is to provide rotary or push-push control switches which can bypass the resistance means of the switch in order to allow more efficient use of energy.

It is also an object of the invention to provide a push-push power control switch capable of operating two or more devices in tandem.

Another object of the invention is to provide interchangeable parts to facilitate manufacture of such power controls.

Another object of the invention is to accomplish said control variation with the fewest number of parts by allowing each major component to have more than one function.

Yet another object of the invention is to design the molded parts so that they could be formed in simple economical two-sided molds requiring no slides or side pull bins.

The foregoing objects are achieved in an adaptable rotary power control switch comprising a switch housing, a shaft-actuator assembly rotatably anchored to the housing, and a circuit board with a variable resistor which is affected by the shaft-actuator assembly. These elements may be easily combined to form any of the following:

a simple rotary control,
a rotary control with full-on bypass,
a three-way rotary control,
a push-push rotary control,
a three-way push-push rotary control, or
a tandem push-push control.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of illustrative embodiments when read in conjunction with the accompanying drawings, wherein:

DESCRIPTION OF THE PREFERRED EMBODIMENTS

Figure 1:
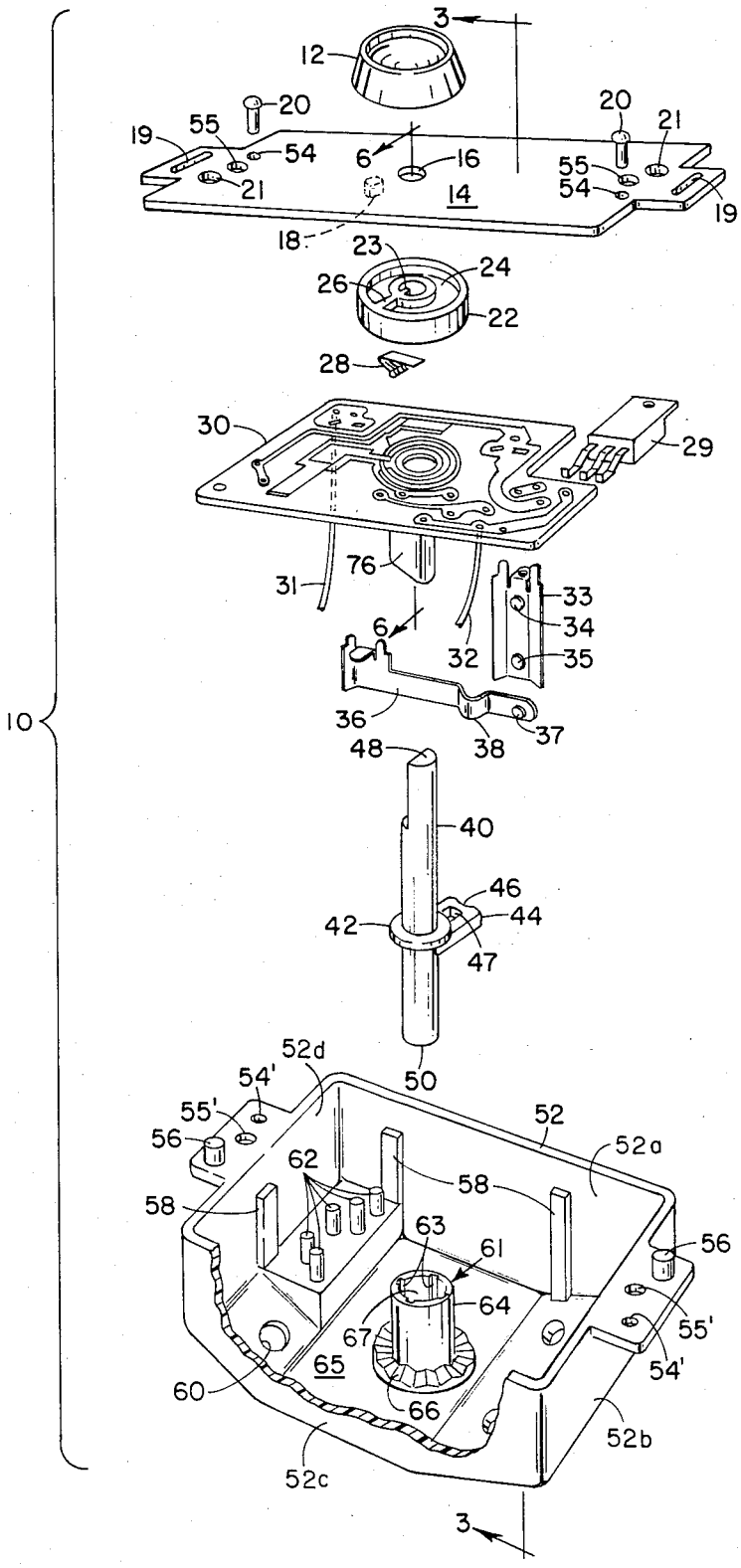
FIG. 1 is an exploded perspective view of the simple rotary control embodiment of the present invention.

With reference now to the Figures and in particular with reference to FIG. 1, there is depicted an exploded view of the simple rotary control embodiment of the present invention. The simple rotary control 10 includes a control knob 12, a strap 14, a wiper shoe 22, a circuit board 30, a contact tab 33, a primary armature 36, a shaft 40, and a generally, rectangular switch housing 52 having four side walls 52*a*, 52*b*, 52*c*, and 52*d*. The switch housing 52 is approximately two and one-half inches long, one and one-half inches wide, and one and one-quarter inches deep. Resting on the interior floor 65 is an anchor 61 for rotatably fastening the lower portion 50 of the shaft 40 thereto. The anchor 61 may be constructed integral with housing 52, or may be attached by other means such as rivets, screws, glue, etc. The anchor 61 is composed of a spline cylinder 64 and a lower reset gear 66. Spline cylinder 64 has an internal passageway 67 therethrough. Passageway 67 has longitudinal grooves 63 formed in the inner walls thereof. Switch housing 52 has one or more exit holes 60 for wire 31 leading to a motor or light and wire 32 leading to the power source, and circuit board supports 58.

The assembly is held in place by strap 14 or an extended finned heat sink with the same mounting features (not shown). Alignment pegs 56 on housing 52 pass through holes 21 on strap 14. Rivets 20 are then inserted into holes 54 and 54'. The device is mounted in a standard electric box using slots 19. Holes 55 and 55' receive screws which mount on an ornamental plate over the entire structure.

The upper portion 48 of the shaft 40 passes through the circuit board 30, wiper shoe 22, and an aperture 16 in strap 14 where it is fastened to control knob 12. The flange 42 of the shaft 40 is located so as to abut the underside of circuit board 30 when the circuit board is forced against the supports 58. The actuator 44 is located just under the flange 42 so as to be able to contact primary armature 36 which is attached to and located on the underside of circuit board 30. Note the contact tab 33 is in front of primary armature 36 in FIG. 1.

Actuator 44 has on its edge a concavity 46 in which rests armature nose 38 in the off position. When the control knob 12 is rotated, the actuator 44 no longer pushes the armature nose 38 thereby causing the armature to make contact with the contact tab 33. Primary armature 36 and contact tab 33 are relatively positioned so that armature contact point 37 is in electrical contact with upper contact point 34 when in the unactuated state.

Figure 2:
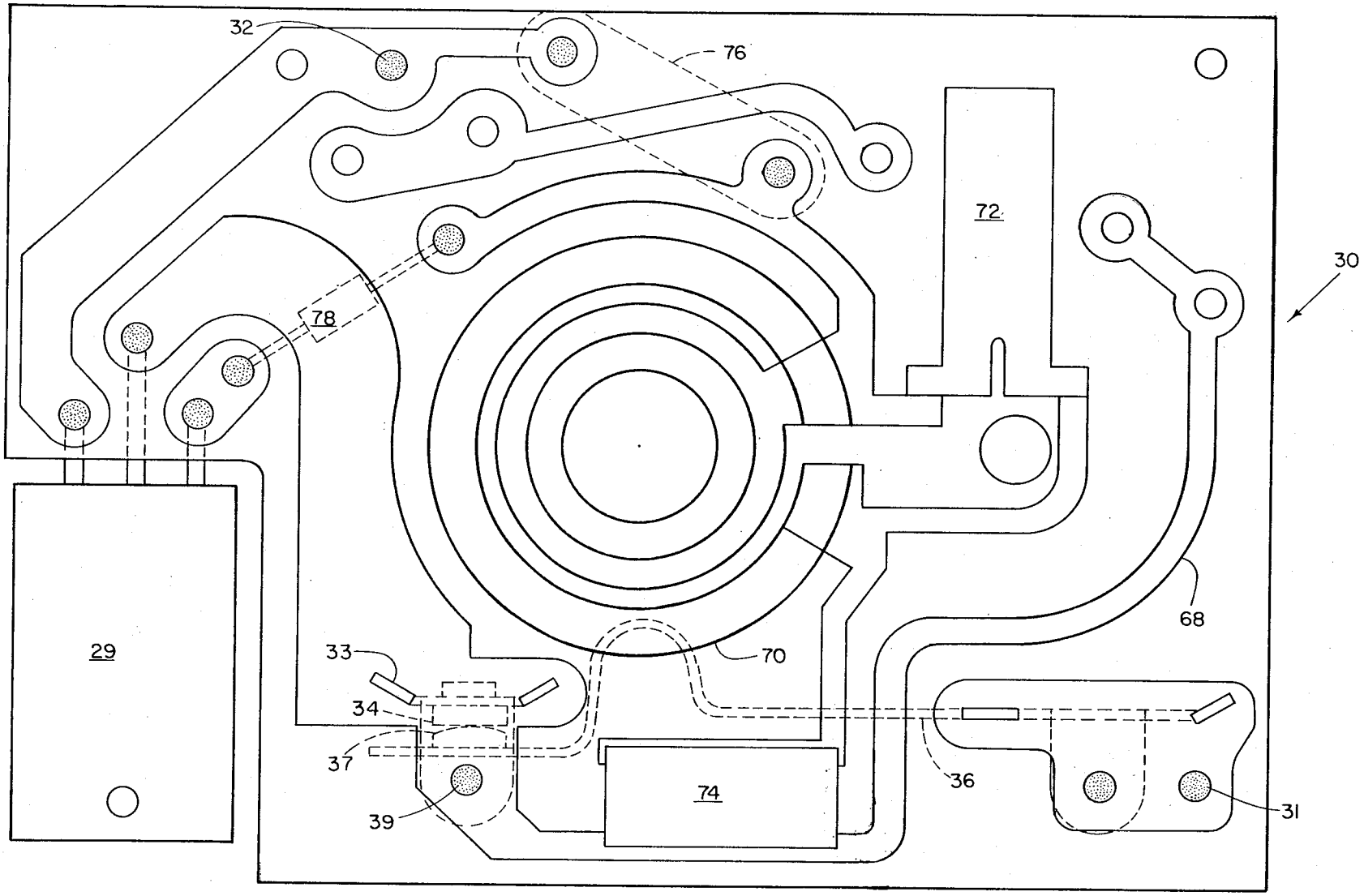
FIG. 2 is a top view of the circuit board of the present invention showing the electrical components as arranged for the simple rotary control.
Figure 5:
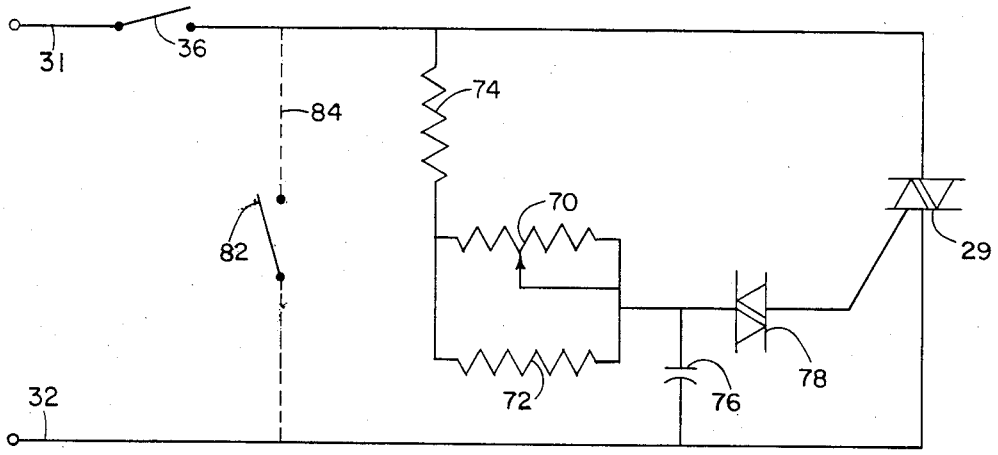
FIG. 5 is a schematic diagram of a simple rotary control embodiment of the present invention also showing the optional full-on bypass.
Figure 6:
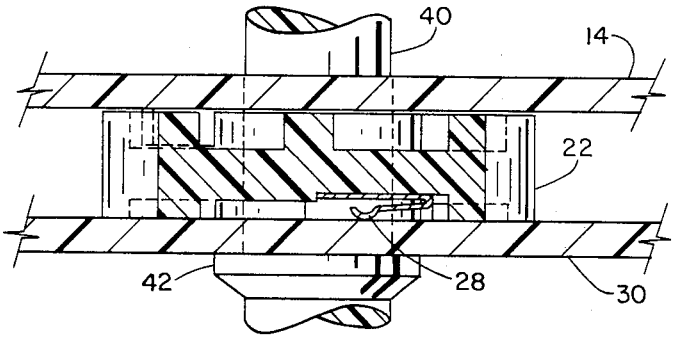
FIG. 6 is a cross sectional view of the wiper assembly of the present invention take along lines 6—6 of FIG. 1.

Referring now to FIGS. 2 and 5, the circuit board 30 is generally planar with electrical strips 68 thereon forming electrical connections between components. Lead wire 31 is in electrical contact with armature 36 which is shown touching contact tab 33. Tab 33 is fastened to circuit board 30 by a rivet 39 and electrically connects to electrical strips 68. The AC input voltage is fed to resistor 74 and triac 29. Resistor 74 further conducts the voltage to variable resistor 70 in parallel with resistor 72, and then to capacitor 76. As the charge of capacitor 76 increases, the voltage across diac 78 also increases. When the limit voltage, either positive or negative, of diac 78 is exceeded, diac 78 will trigger conduction of triac 29. The resistance of variable resistor 70 is controlled by the wiper shoe 22 (see FIG. 1). Thus the power allowed to flow through triac 29 may be increased or decreased, thereby delaying when in each half cycle the triac 29 fires.

Figure 3:
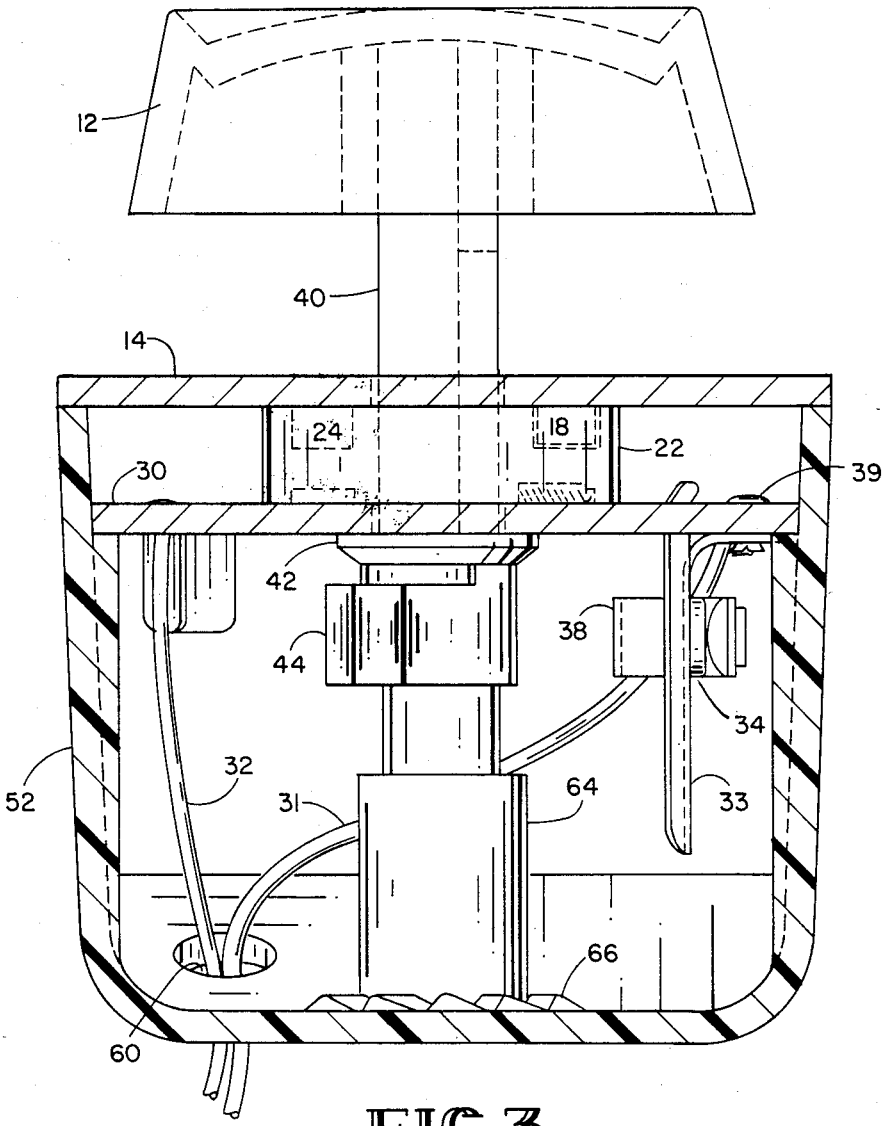
FIG. 3 is a cross-sectional view of the simple rotary control embodiment of the present invention taken along the lines 3—3 of FIG. 1.
Figure 4:
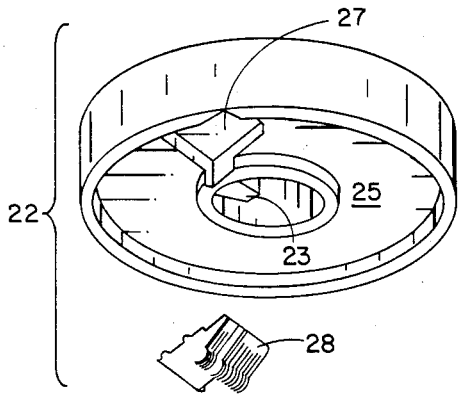
FIG. 4 is a lower perspective view of the wiper shoe element of the present invention.

With reference to FIGS. 1, 3, and 4, wiper shoe 22 is rotatably connected to shaft 40 by means of an inwardly extending sprocket 23 which mates with a longitudinal groove 103 (shown in FIG. 10) in the upper portion of shaft 40. Wiper shoe 22 has an annular depression 25 on its bottom surface and a rectangular seat 27 in which sits a wiper 28 having dual contacts slidably urged against variable resistor 70. Rotation of control knob 12 causes rotation of wipe shoe 22 and movement of wiper 28, thus increasing or decreasing the resistance of variable resistor 70. Annular depression 25 serves to protect the wiper 28 from damage caused by excessive external forces. Rotation of wiper shoe 22 is limited by a peg 18 which may also be a coined projection made from the strap material mounted on the bottom of strap 14 which forcibly contacts a radial rib 26 set in an annular depresssion 24 in the upper surface of wiper shoe 22. The actuator 44 is placed at an appropriate angle with respect to the longitudinal groove 103 in shaft 40 whereby, when shaft 40 is rotated to an acute rotational position limited by the interaction of peg 18 with radial rib 26, the actuator 44 is perpendicular to and pushing primary armature 36 away from contact tab 33.

Figure 8:
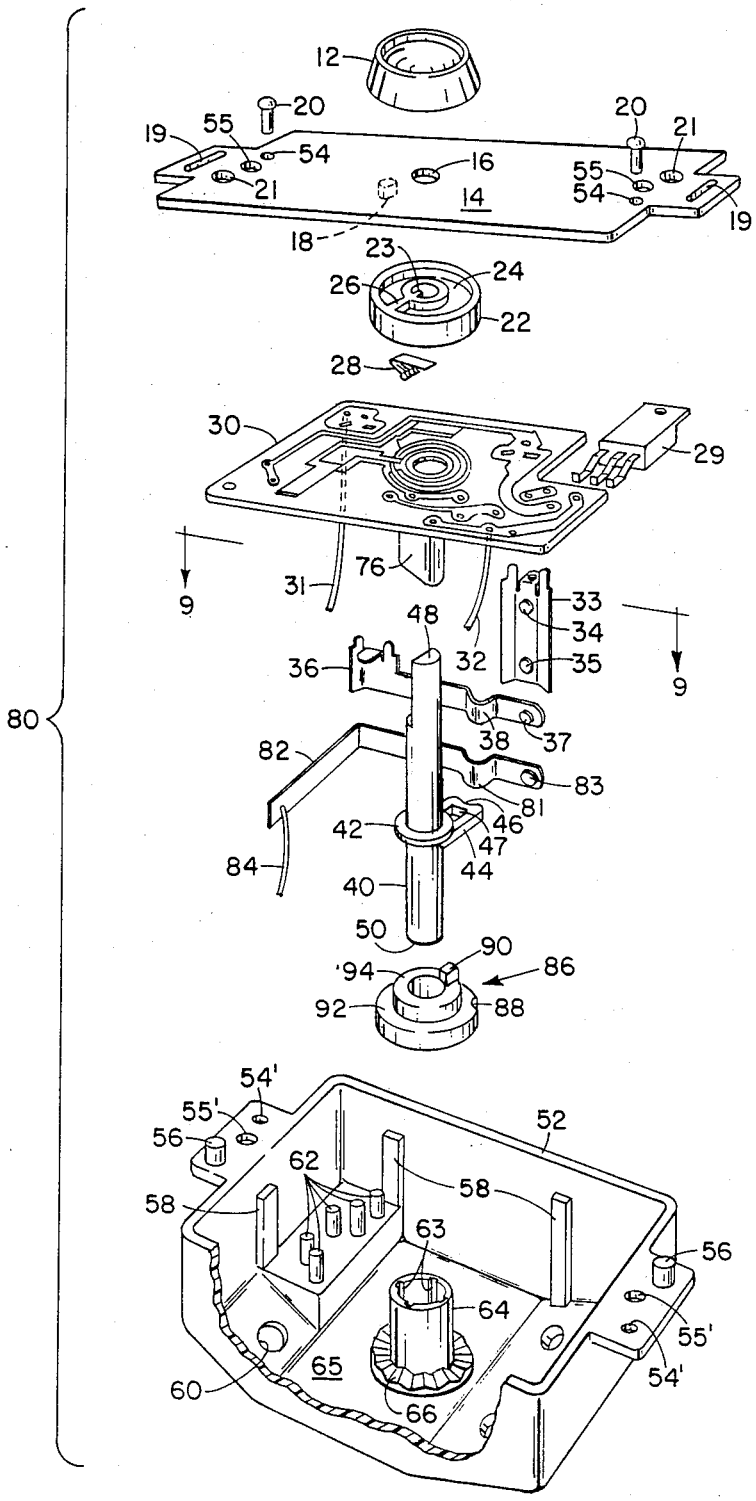
FIG. 8 is an exploded perspective of the rotary control with full-on bypass embodiment of the present invention.

Referring now to FIG. 8, there is depicted an exploded view of the rotary control will full-on bypass embodiment of the present invention. FIG. 5 depicts the schematic for this control. Rotary control with full-on bypass 80 is identical to the simple rotary control 10 with the addition of a secondary armature 82 having lead wire 84 and a bypass actuator 86. Secondary armature 82 is attached to the switch housing 52 by means of pegs 62 integral with the housing 52, which pegs 62 can be mushroomed after placement of secondary armature 82 therein so as to securely hold the secondary armature in place. Pegs 62 are raised above the floor 65 whereby secondary armature contact point 83 may touch the lower contact point 35 of contact tab 33. Note the pegs 62 may be present in the simple rotary control embodiment 10 of the present invention without affecting the functionality thereof. Referring to FIG. 5, it may be seen that when armature 82 is open (83 is not in electrical contact with 35), power flows through the circuitry on board 30 to the load via wire 31 when armature 36 is closed. In the bypass mode, armature 82 is closed (83 in electrical contact with 35), power bypasses the circuitry on board 30 and flows through lead wire 84 when armature 36 is closed.

The bypass actuator 86 has an upper tier 94, a lower tier 92, and a central aperture for passage of the lower portion 50 of the shaft 40. The bypass actuator 86 is upwardly held in place by the top surface of spline cylinder 64, and is rotatably fastened to the shaft 40 by means of a mortise 47 in the actuator 44 and a tenon 90 integral with the upper tier 94. Note the shaft 40 is the same shaft used in the rotary control 10; the presence of mortise 47 does not affect the functionality of the actuator 44.

Figure 9:
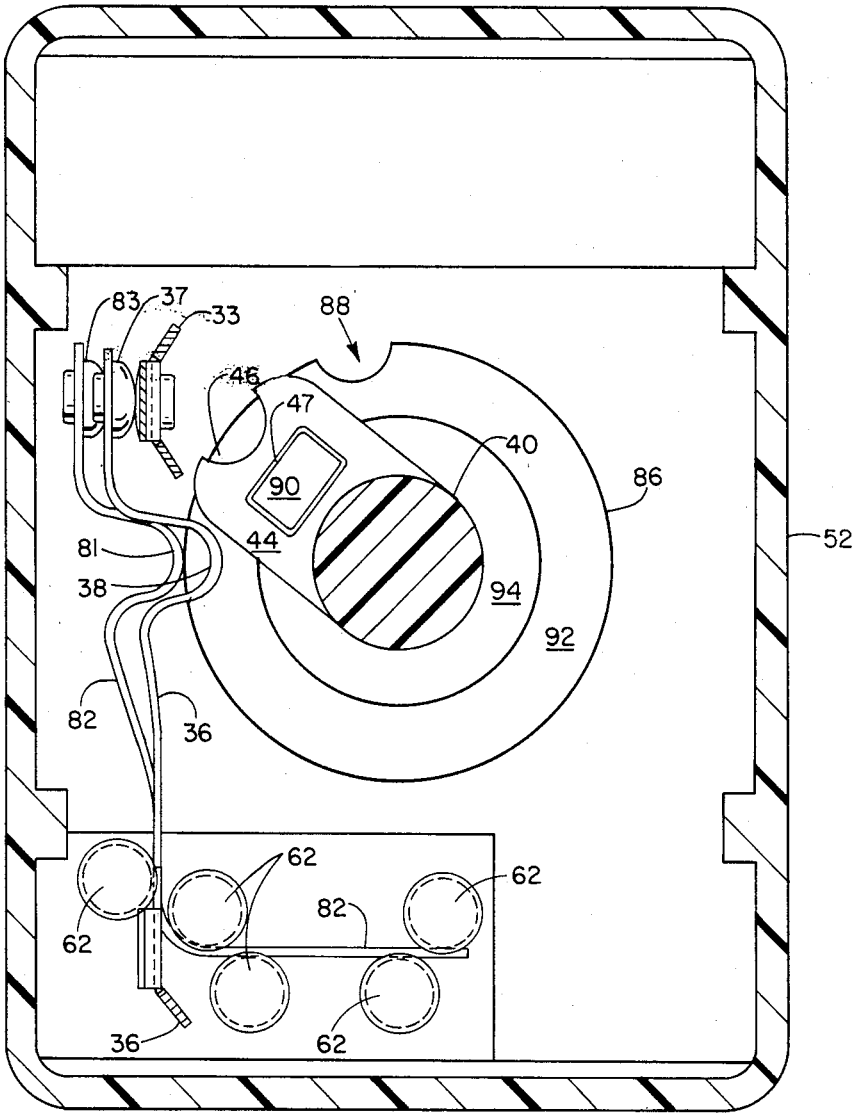
FIG. 9 is a cross-sectional view of the rotary control with full-on bypass embodiment of the present invention taken along lines 9—9 of FIG. 8.

With reference to FIG. 9, the upper tier 94 has a smaller diameter than the lower tier 92. The lower tier 92 has a diameter sufficient to push the secondary armature 82 away from the contact tab 33, and the lower tier 92 has a concavity 88 along its outer edge. The concavity 88 is placed at an appropriate angle with respect to the tenon 90 whereby, when the shaft 40 is rotated to an obtuse rotational position limited by the interaction of peg 18 and radial rib 26, the concavity receives the secondary armature nose 81 allowing the secondary armature contact point 83 to touch the lower contact point 35 of the contact tab 33. Secondary armature 82 is also indicated by dashed lines in FIG. 5. Note the obtuse rotational position corresponds to minimum resistance of variable resistor 70 in the case of a power control for a light.

Where the power control is for a motor, the user may desire to have the acute rotational position correspond to minimum resistance and this alternative embodiment would require that the concavity 88 be placed at an appropriate angle with respect to the simple actuator 44 so that the concavity 88 would receive the secondary armature nose 81 immediately upon rotating the shaft away from the acute rotational position.

Figure 7:
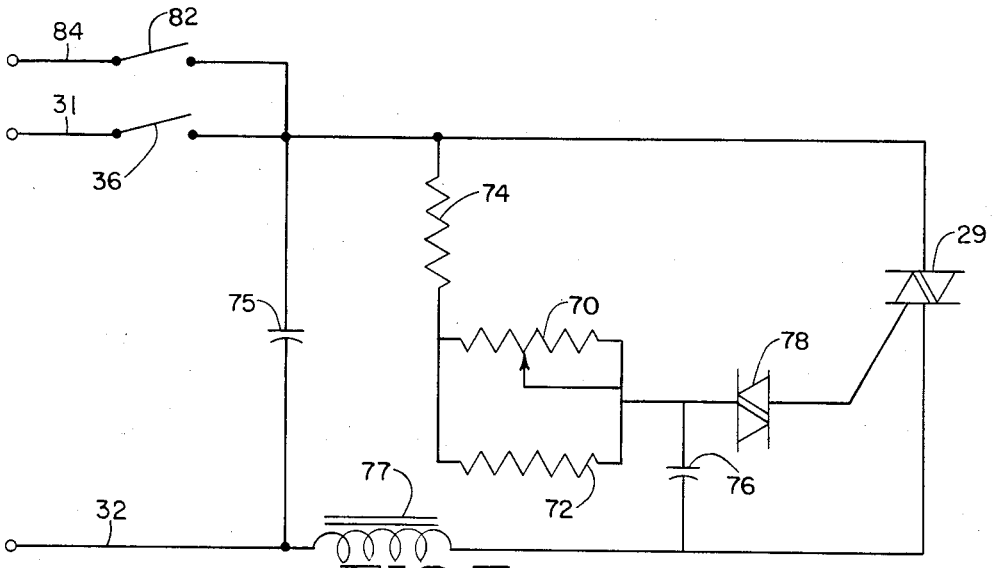
FIG. 7 is a schematic diagram of the three-way rotary or push control of the present invention.

FIG. 7 depicts an electrical schematic for such a device similar to FIG. 5 with the addition of a capacitor 75 connected to the power source wire lead wire 32 and a choke 77 connected in series to the triac 29. Wires 31 and 84 are electrically connectable to the load. Note circuit board 30 easily accommodates the components of FIG. 7. Many other state-of-the-art circuits exist that circuit board 30 can accommodate such as fluorescent, low voltage and voltage compensated circuits (not shown).

Figure 10:
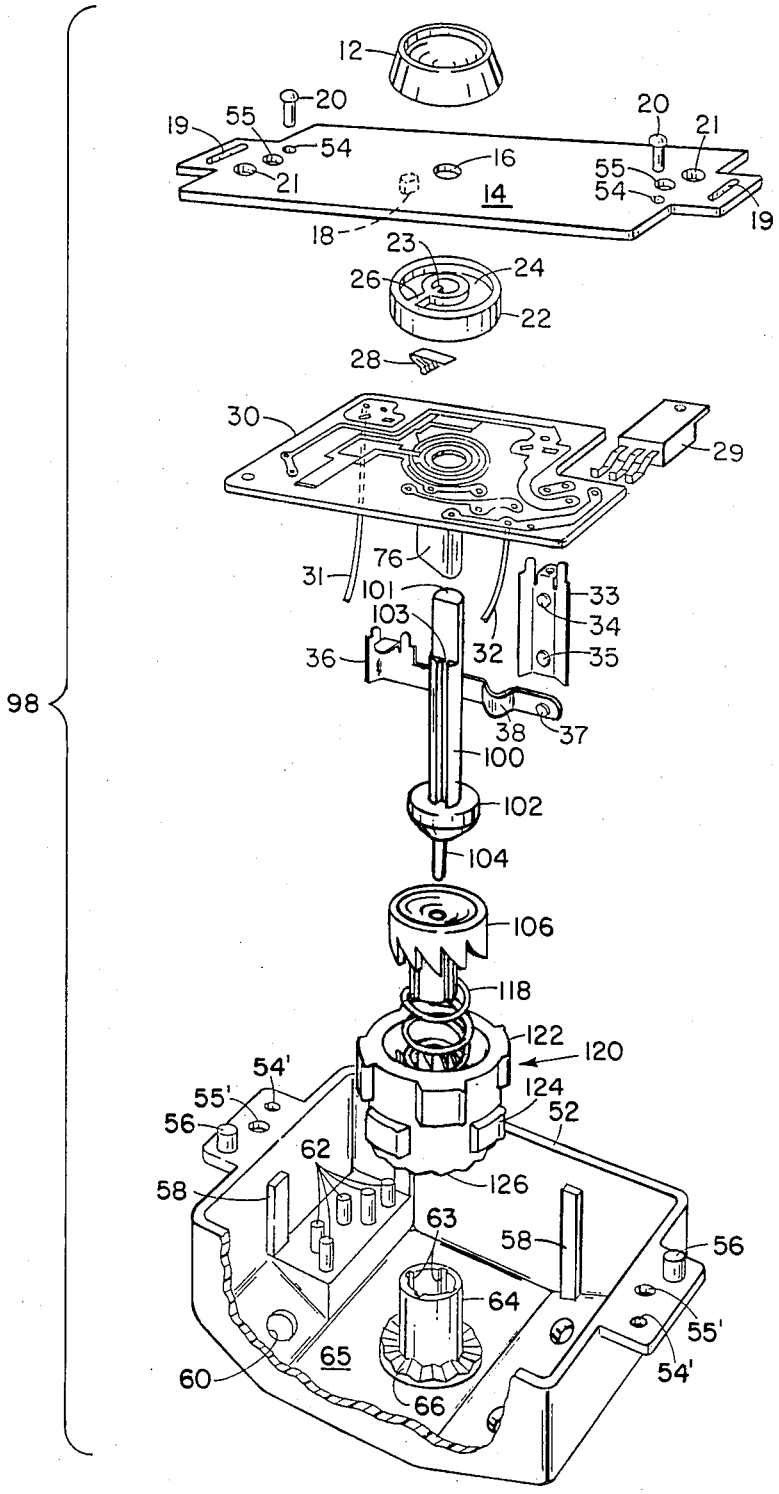
FIG. 10 is an exploded perspective view of the push-push rotary control embodiment of the present invention.

With reference to FIG. 10, there is depicted an exploded view of a push-push control embodiment of the present invention. The push-push control 98 is similar to the rotary control 10 with the exception of the shaft-actuator assembly. The shaft 40 as shown in FIG. 1 is now replaced by a shaft 100 having an upper portion 101 which extends through aperature 16 in strap 14, and the actuator 44 shown in FIG. 1 is now replaced by an indexing gear 106, a spring 118, and a push-push actuator 120. The shaft 100 has a longitudinal groove 103, which terminates at flange 102 which downwardly tapers to an alignment pin 104.

Figure 11:
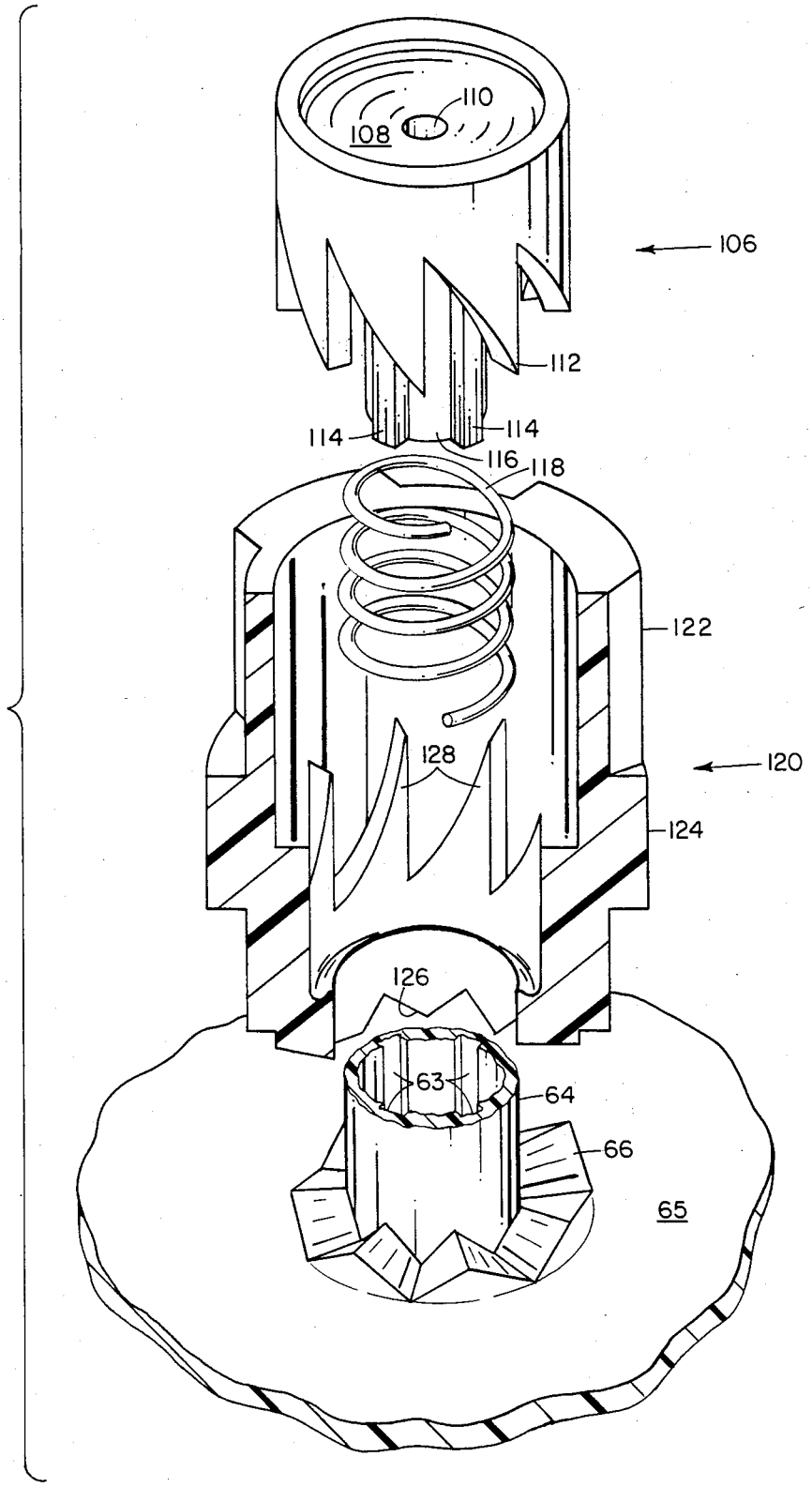
FIG. 11 is a partial perspective/cross-sectional view of the push-push actuator assembly of FIG. 10.

With further reference to FIG. 11, the shaft 100 mates and engages with indexing gear 106 whereby the tapered flange 102 sits in a concavity 108, and alignment pin 104 is received by an aperture 110. The indexing gear 106 has upper indexing teeth 112 and a central spline shaft 116 with splines 114. Push-push actuator 120 is a hollow cylinder with lower indexing teeth 128 therein, upper lobes 122 equally spaced on the outer surface thereof for actuation of armature 36, and an upper reset gear 126 on the bottom thereof. Spline cylinder 64 extends upwardly through push-push actuator 120, push-push actuator 120 resting on lower reset gear 66. The inner diameter of push-push actuator 120 is slightly larger than the outer diameter of indexing gear 105 whereby indexing gear 106 may be placed inside push-push actuator 120. Spline shaft 116 of indexing gear 106 also rests inside spline cylinder 64 with splines 114 engaging grooves 63, thus preventing indexing gear 106 from rotating but allowing longitudinal motion. A spring 118 lies inside push actuator 120 surrounding spline cylinder 64 and extends upwardly where it abuts an annular space surrounding spline shaft 116, thus pushing indexing gear 106 away from push-push actuator 120.

The indexing action of the push-push actuator assembly can be easily understood with reference to FIG. 12. FIG. 12A depicts the inner workings of the actuator assembly in its relaxed state. Equally spaced upper indexing teeth 112 lie just above equally spaced lower indexing teeth 128. The vertical edge of the upper indexing teeth 112 is shifted slightly away from the vertical edge of the lower indexing teeth 128. Upper reset gear 126 is fully meshed with lower reset gear 66.

Figure 12A:
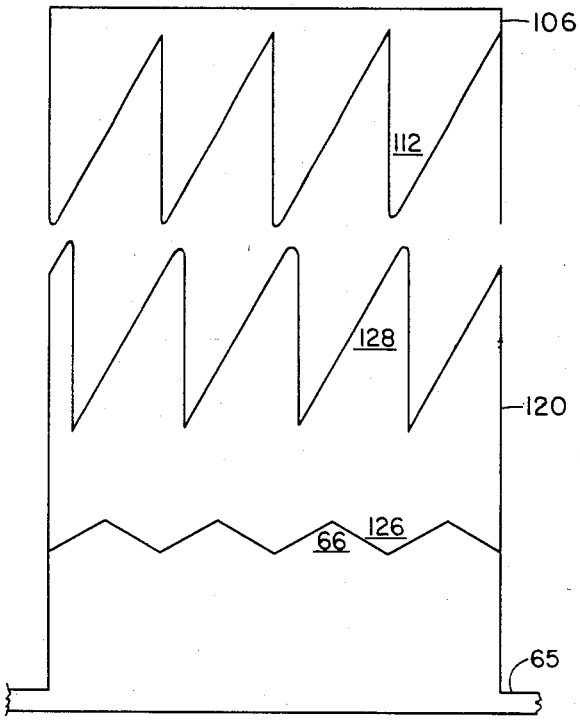
FIGS. 12A through 12D are representational diagrams of the interaction of the indexing gear with the push-push actuator of the present invention.
Figure 12B:
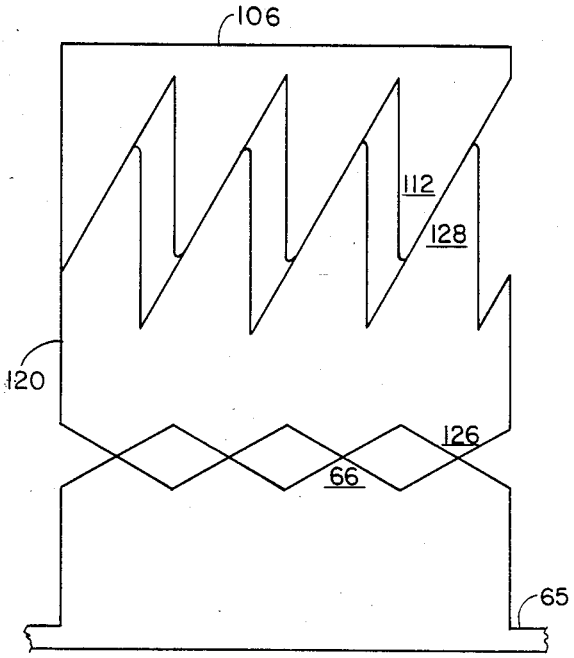

In FIG. 12B, the shaft 100 has been partially depressed causing upper indexing teeth 112 to begin to mesh with lower indexing teeth 128, thus exerting a torque upon push-push actuator 120, disengaging upper and lower reset gears 126 and 66.

Figure 12C:
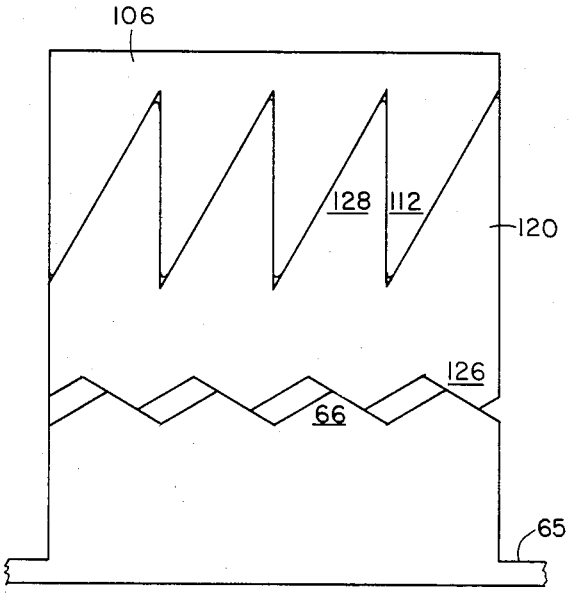

In FIG. 12C, the shaft 100 is fully depressed and upper indexing teeth 112 are fully meshed with lower indexing teeth 128. Upper reset gear 126 has advanced approximately three-quarters of a cycle.

Figure 12D:
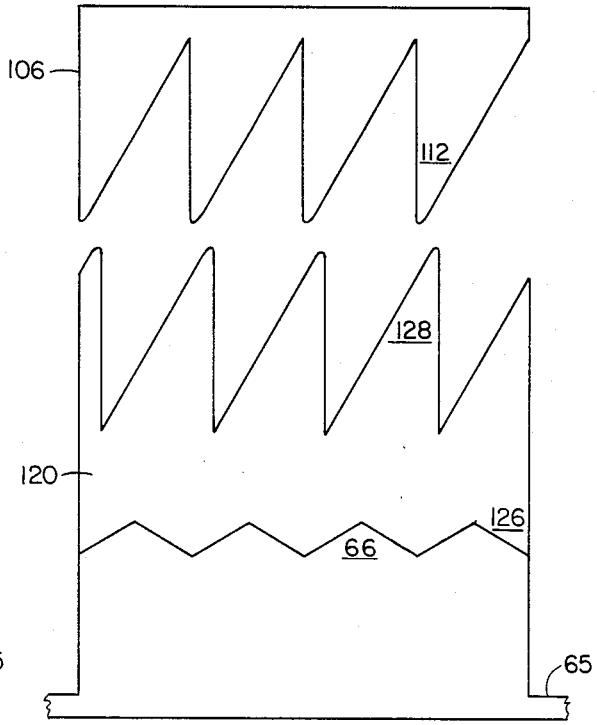

In FIG. 12D, when the shaft 100 is released and upper indexing teeth 112 no longer act upon lower indexing teeth 128, push-push actuator 120 returns to its relaxed state by action of upper and lower reset gears 126 and 66, respectively, due to the force exerted by spring 118. The number of indexing teeth should correspond to twice the number of upper lobes 122 on the outer surface of push actuator 120 (see FIGS. 10 and 11), whereby successive depression of shaft 100 results in actuation of armature 36, no actuation, actuation, etc.

Both the grooves in spline shaft 64 and the lower reset gear 66 are unnecessary in the rotary control embodiment 10 and rotary control with full-on bypass embodiment 80, but their presence does not affect the functionality of those embodiments. The push actuation mechanism may be used to advance any type of rotor.

Figure 13:
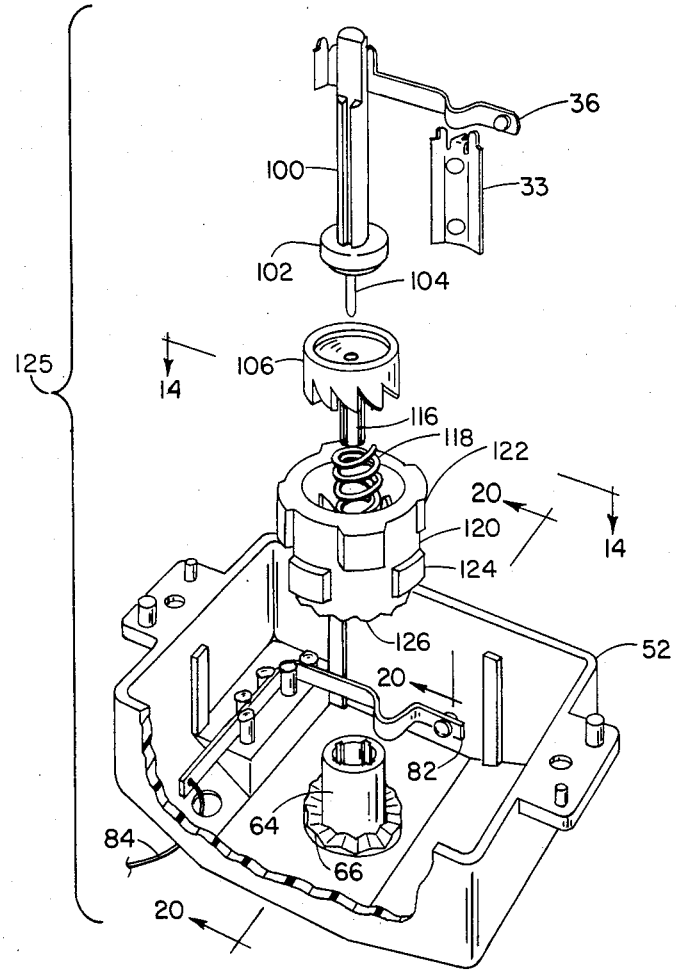
FIG. 13 is an exploded perspective view of the three-way push-push rotary control embodiment of the present invention.
Figure 14:
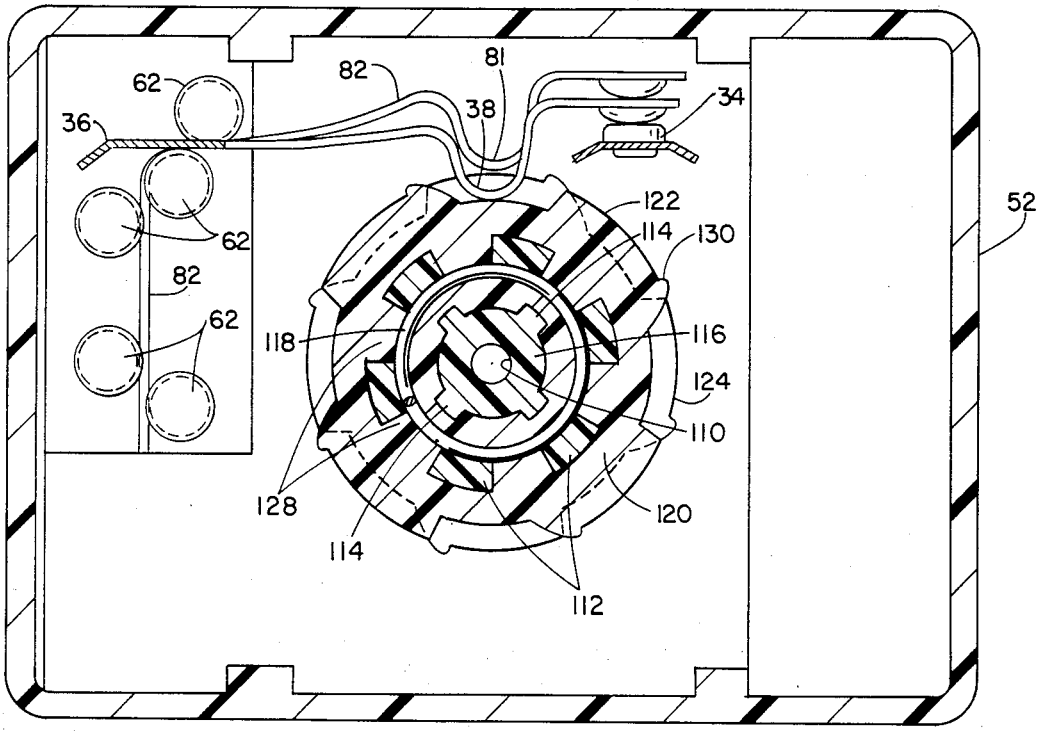
FIG. 14 is a cross-sectional view of the three-way push-push rotary control embodiment of the present invention take along lines 14—14 of FIG. 13.
Figure 20:
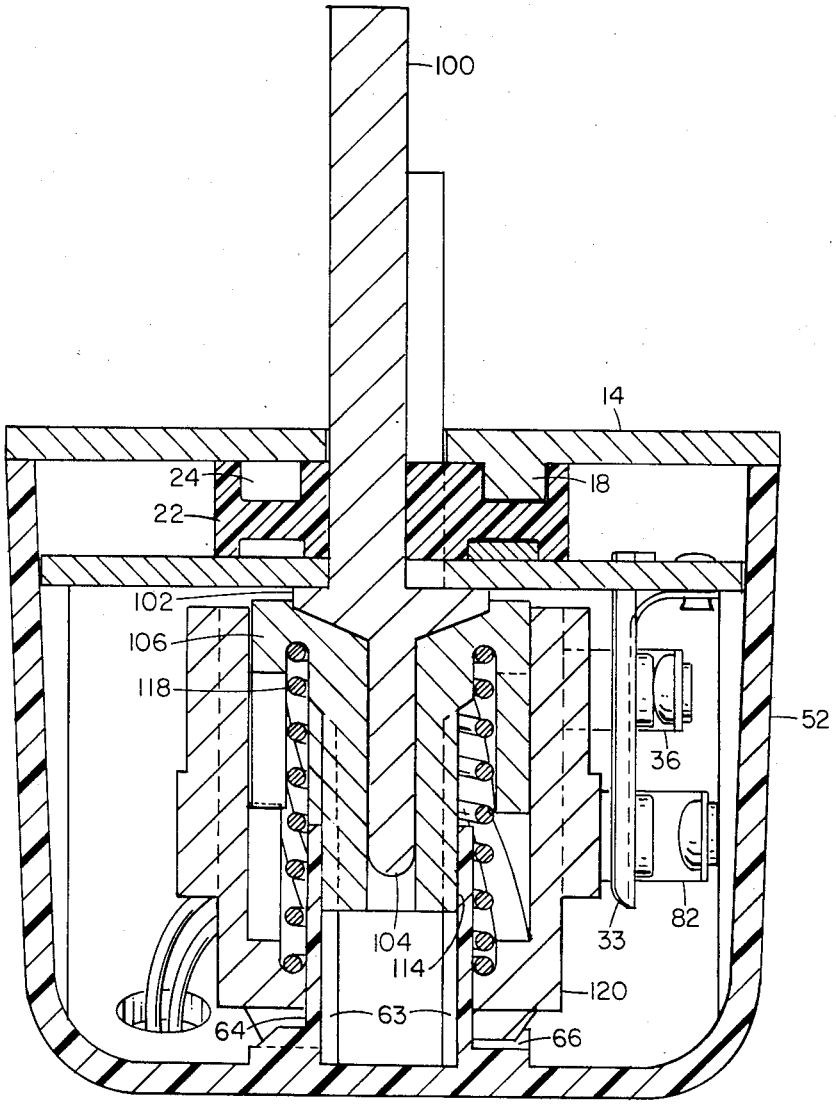
FIG. 20 is a cross sectional view of the three-way push-push rotary control embodiment of the present invention taken along lines 20—20 of FIG. 13.

With reference to FIGS. 13, 14 and 20, there is depicted a three-way push-push control embodiment of the present invention. The three-way push-push control 125 is identical to the push control 98 with the addition of a secondary armature 82. Lower lobes 124 are placed on the outer surface of push-push actuator 120 out of phase with the upper lobes 122. Thus the push-push actuator 120 will alternately actuate primary armature 36 and secondary armature 82 having lead wire 84. Both upper and lower lobes 122 and 124 have bumps 130 on their leading edges to insure proper actuation. The circuitry for the three-way push-push control 125 is also shown in FIG. 7, previously described. The lower lobes 124 are extraneous to the push control embodiment 98, but their presence does not affect the functionality of that embodiment.

Figure 15:
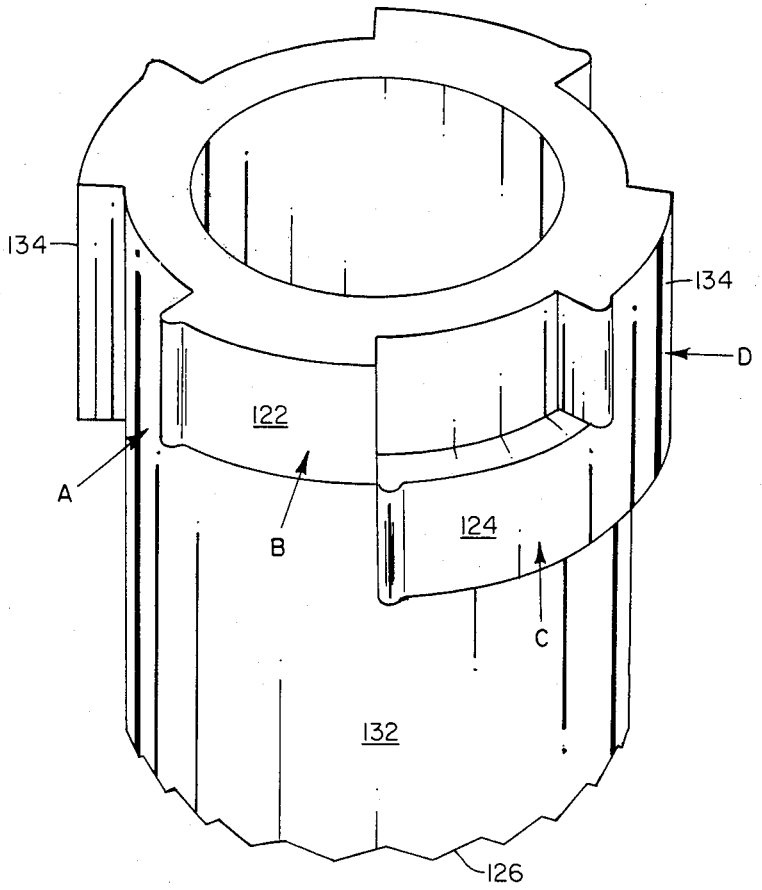
FIG. 15 is a perspective view of the tandem push-push rotary actuator of the present invention.

FIG. 15 depicts a tandem actuator 132 to be used in place of push-push actuator 120 in order to form a tandem push-push control embodiment of the present invention. The structure of the tandem actuator 132 is identical to the structure of push-push actuator 120 with the exception of differing placement of upper and lower lobes 122 and 124. As can be seen in FIG. 15 at position A on actuator 132, there is neither an upper lobe 122 nor a lower lobe 124. At position B there is only an upper lobe 122; at position C there is only a lower lobe 134 which is an integral upper lobe 122 and lower lobe 124. The cyclical progression of these lobes is such that there are four actuation states: (1) at position A no actuation, (2) at position B actuation of primary armature 36 only, (3) at position C actuation of secondary armature 82 only, and (4) at position D actuation of both primary armature 36 and secondary armature 82. The circuitry for the tandem push-push control is depicted in FIG. 7, previously described. A multiplicity of devices may be so controlled by adding additional armatures to the housing and additional lobes to the tandem actuator.

Figure 16:
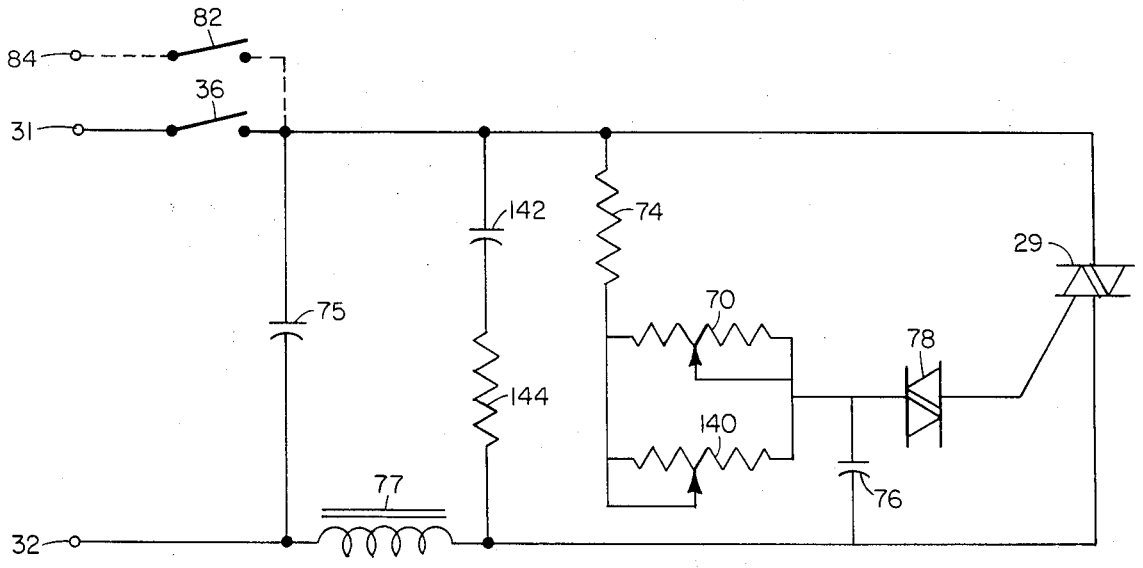
FIG. 16 is a schematic diagram showing alternative circuitry of the present invention.
Figure 17:
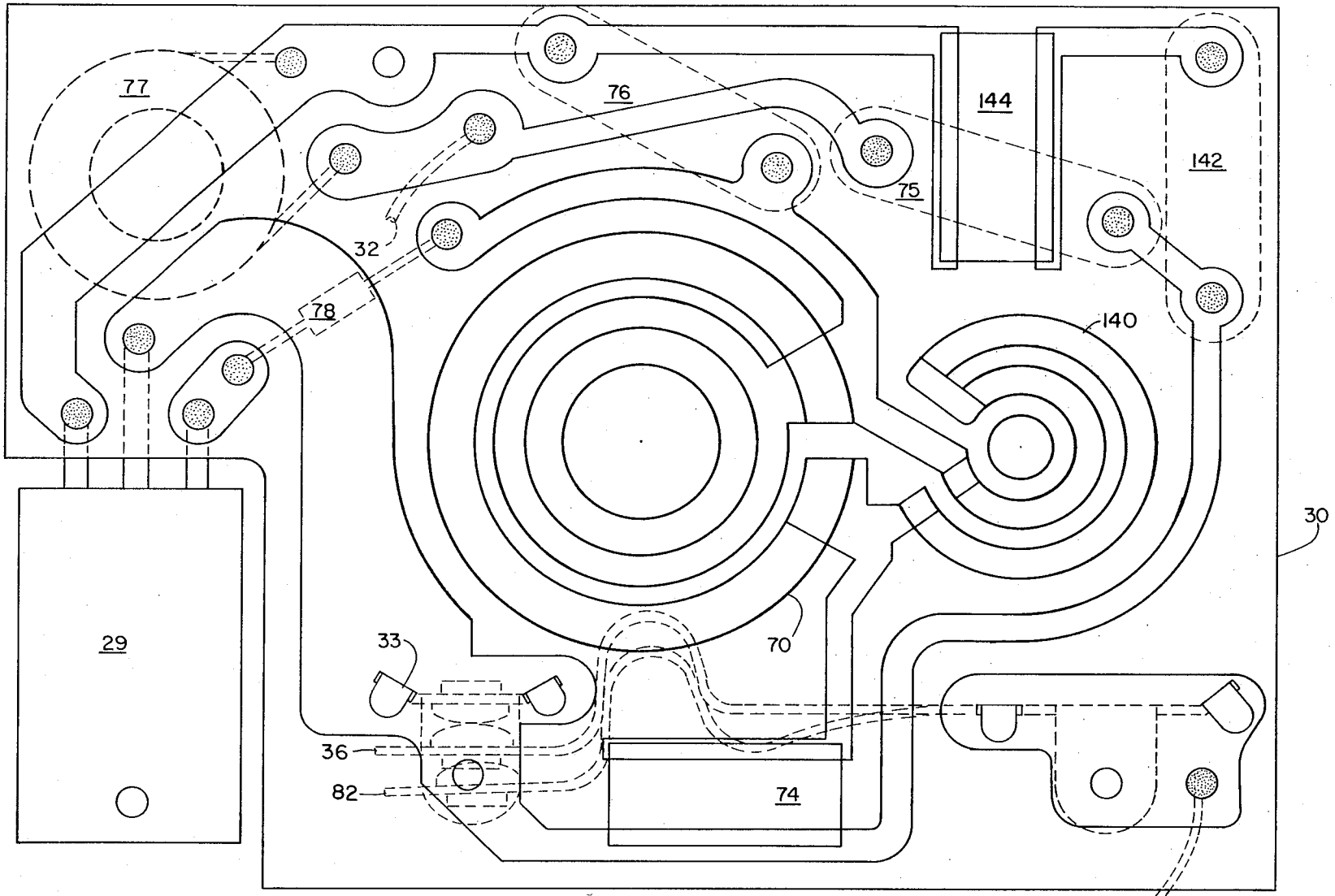
FIG. 17 is a top view of the circuit board of the present invention showing the electrical components as arranged for the tandem or three-way push-push rotary controls including the optional trimming variable resistor.
Figure 18:
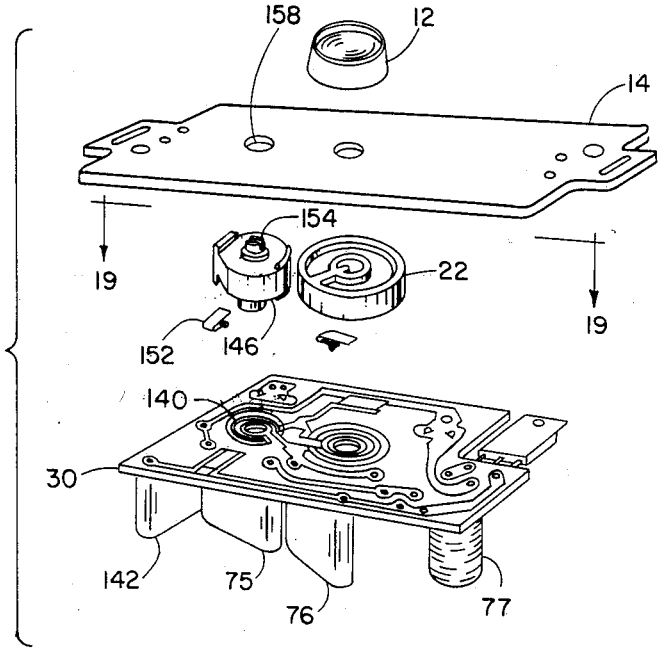
FIG. 18 is an exploded perspective view of the upper portion of the present invention showing the optional trimming resistor assembly.
Figure 19:
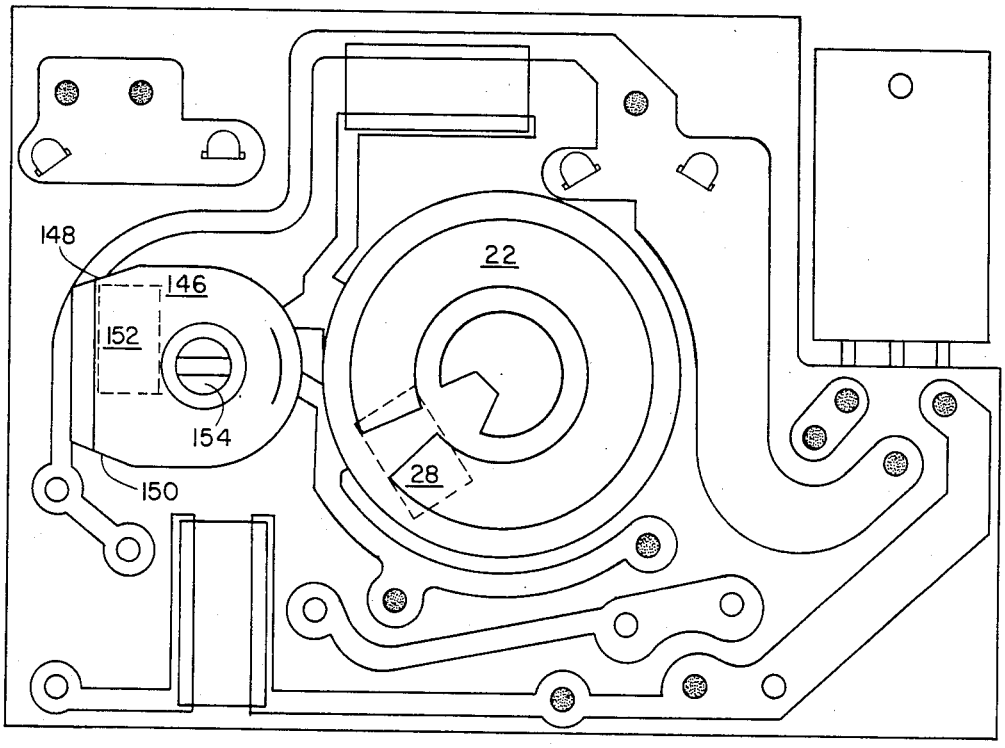
FIG. 19 is a top view of the circuit board taken along lines 19—19 of FIG. 18, similar to FIG. 17 but showing the trimming resistor assembly in place.

With reference to FIGS. 16 and 17, there is depicted an alternative embodiment of circuit board 30. Two separate features are reflected in these drawings. The first is an RC filter indicated by capacitor 142 and resistor 144, useful in switches for motor control as opposed to incandescent lighting. The second feature is a trimming variable resistor 140 for fine tuning the resistance of the overall circuit. With further reference to FIGS. 18 and 19, there is illustrated the mechanism for adjusting the trimming variable resistor 140. The U-shaped trimming wiper shoe 146 is similar to wiper shoe 22 in that it is placed over trimming variable resistor 140, and it holds a wiper 152 with dual contacts which are slidably urged against trimming variable resistor 140. Trimming wiper shoe 146 is rotatably fastened to circuit board 30 by a slotted advancing bolt 154, accessible through an aperture 158 in strap 14. When the device is first installed, trimming variable resistor 140 is optimally adjusted by inserting a screwdriver or other suitable implementing into aperture 158, and turning advancing bolt 154. The rotation of trimming wiper shoe 146 is limited by stops 148 and 150 which will abut the outer edge of wiper shoe 22.

Although the invention has been described with reference to specific embodiments, this description is not meant to be construed in a limiting sense. Various modifications of the disclosed embodiments will become apparent to persons skilled in the art upon reference to the description of the invention. It is therefore contemplated that the appended claims will cover such modifications that fall within the true scope of the invention.

I claim:

1. An adaptable rotary power control switch comprising:

a switch housing having an open side, an interior floor and side walls;

an anchor means with a cylindrical bore therein for rotatably attaching a chosen one of a variety of shaftactuator assemblies with upper and lower portions to said interior floor said lower portions dimensioned to slidably fit into said cylindrical bore in said anchor means;

a power-limiting circuit board for receiving electrical components in differing arrangements, having an aperture for passage of said upper portion of said chosen shaft-actuator assembly;

contact means activated by rotation of said chosen shaft-actuator assembly causing electricity to flow from a power source through said circuit board;

wiper means operated by said shaft-actuator assembly whereby rotation of said chosen shaft-actuator assembly affects first variable resistance means, said first variable resistance means being integral with said circuit board; and a planar strap having top and bottom sides for retaining said chosen shaft-actuator assembly, said circuit board, and said wiper means within said switch housing, said strap covering said open side of said switch housing, and having a first aperture for passage of said upper portion of said chosen shaft-actuator assembly.

2. An adaptable rotary power control switch as recited in claim 1, said contact means further comprising:

at least one armature with a first and a second end for electrical connection at said first end to said power source;

a contact tab electrically connected to said circuit board; and said armature being movable by said chosen shaft-actuator assembly whereby said second end of said armature is electrically coupled to said contact tab allowing electricity to flow therethrough and energizing said circuit board thereby.

3. An adaptable rotary power control switch as recited in claim 2, said switch housing comprising:

support means mounted on said side walls for supporting said circuit board;

attachment means for securing said strap to said switch housing;

peg means for attachment of at least one of said armatures to said switch housing; and said switch housing having an exit aperture for power supply wires.

4. An adaptable rotary power control switch as recited in claim 3, said wiper means comprising:

a circular wiper shoe with a top surface and bottom surface having a central aperture and an inwardly extending sprocket for axial connection with said chosen shaft-actuator assembly, said wiper shoe also having an annular depression and a radial rib on said top surface, and having an annular depression and rectangular seat on said bottom surface, said wiper shoe parallel to and located in between said circuit board and said strap;

a first wiper having dual contacts, said first wiper located in said rectangular seat of said wiper shoe, said dual contacts slidably urged against said first variable resistance means; and a stop peg mounted on said bottom side of said strap for limiting rotational movement of said wiper shoe by forcible contact with said radial rib, said forcible contact occurring at an acute rotational position of said wiper shoe and at an obtuse rotational position of said wiper shoe.

5. An adaptable rotary power control switch as recited in claim 4, said anchor means comprising:

a spline cylinder attached and perpendicular to said interior floor for mating with said lower portion of said chosen shaft-actuator assembly; and a lower reset gear attached to said interior floor and surrounding said spline cylinder.

6. An adaptable rotary power control switch as recited in claim 5 further comprising:

a U-shaped wiper shell having top and bottom surfaces, located adjacent to said wiper shoe, rotatably fastened to said circuit board, said wiper shell having a central slotted advancing bolt accessible through a second aperture of said strap, and having on said bottom surface an annular depression and a rectangular seat; and a second wiper having dual contacts, said second wiper located in said rectangular seat of said wiper shell, said dual contacts slidably urged against second variable resistance means, said second variable resistance means being integral with said circuit board.

7. An adaptable rotary power control switch as recited in claim 1, said anchor means comprising:

a spline cylinder attached and perpendicular to said interior floor of said switch housing for mating with said lower portion of said chosen shaftactuator assembly; and a lower reset gear attached to said interior floor and surrounding said spline cylinder.

8. An adaptable rotary power control switch as recited in claim 7 wherein said chosen shaft-actuator assembly is a simple push control comprising:

a shaft having a longitudinal groove for mating with said wiper means, said shaft having at one end a flange integral which tapers away from said shaft ending in an alignment pin;

a circular indexing gear having upper and lower ends, said upper end having a concave seat and aperture for mating with said tapered flange and alignment pin, said lower end having upper indexing teeth, and having a central spline shaft for mating with said spline cylinder of said anchor means;

a hollow, cylindrical push actuator with upper and lower ends having therein lower indexing teeth for meshing with said upper indexing teeth, said push actuator having upper lobes on the outer surface thereof for pushing said contact means, and having at said lower end an upper reset gear for meshing with said lower reset gear of said anchor means; and a spring for displacing said indexing gear away from said push actuator.

9. An adaptable rotary power control switch as recited in claim 7 wherein said contact means comprises a first armature and a second armature, and wherein said chosen shaft-actuator assembly is a three-way push control comprising:

a shaft having a longitudinal groove for mating with said wiper means, said shaft having at one end a flange integral therewith which tapers away from said shaft ending in an alignment pin;

a circular indexing gear having upper and lower ends, said upper end having a concave seat and aperture for mating with said tapered flange and alignment pin, said lower end having upper indexing teeth, and having a central spline shaft for mating with said spline cylinder of said anchor means;

a hollow, cylindrical push actuator with upper and lower ends having therein lower indexing teeth for meshing with said upper indexing teeth, said push actuator having upper lobes on the outer surface thereof for pushing said first armature and having lower lobes on the outer surface thereof for pushing said second armature, said lower lobes placed out of phase with said upper lobes, said push actuator also having at said lower end an upper reset gear for meshing with said lower reset gear of said anchor means; and a spring for displacing said indexing gear away from said push actuator.

10. An adaptable rotary power control switch as recited in claim 7 wherein said contact means comprises a first armature and a second armature, and wherein said chosen shaft-actuator assembly is a tandem push control comprising:

a shaft having a longitudinal groove for mating with said wiper means, said shaft having at one end a flange integral therewith which tapers away from said shaft ending in an alignment pin;

a circular indexing gear having upper and lower ends, said upper end having a concave seat and aperture for mating with said tapered flange and alignment pin, said lower end having upper indexing teeth, and having a central spline shaft for mating with said spline cylinder of said anchor means;

a hollow, cylindrical push actuator with upper and lower ends having therein lower indexing teeth for meshing with said upper indexing teeth, said push actuator having upper lobes on the outer surface thereof for pushing said first armature and having lower lobes on the outer surface thereof for pushing said second armature, the cyclical rotational progression of such upper and lower lobes being (i) upper lobe only, (ii) lower lobe body, (iii) both upper and lower lobes, and (iv) neither upper now lower lobes, said push actuator also having at said lower end an upper reset gear for meshing with said lower reset gear of said anchor means; and a spring for displacing said indexing gear away from said push actuator.

11. An adaptable rotary power control switch as recited in claim 1 whreein said chosen shaft-actuator assembly is a simple rotary control comprising:

a shaft with upper and lower portions, said shaft having a longitudinal groove in said upper portion for mating with said wiper means;

a flange integral with said shaft located near the center of said shaft; and a first simple actuator integral with said shaft located between said flange and said lower portion of said shaft, said first simple actuator placed at an appropriate angle with respect to said longitudinal groove whereby said first simple actuator pushes against said contact means when said wiper means is rotated to an acute rotational position.

12. An adaptable rotary power control switch as recited in claim 1 wherein said contact means comprises a first armature and a second armature, and wherein said chosen shaft-actuator assembly is a rotary control with full-on bypass comprising:

a shaft with upper and lower portions, said shaft having a longitudinal groove in said upper portion for mating with said wiper means;

a flange integral with said shaft located near the center of said shaft; and a first simple actuator integral with said shaft located between said flange and said lower portion of said shaft, said first simple actuator placed at an appropriate angle with respect to said longitudinal groove whereby said first simple actuator pushes against said first armature when said wiper means is rotated to an acute rotational position, and said first simple actuator having a mortise therein; and a circular bypass actuator having upper and lower tiers and having a central aperture for passage of said lower portion of said shaft, said upper tier having a smaller diameter than said lower tier, said upper tier having integral thereto a tenon for alignment with said mortise, said lower tier having a concavity along its edge, said concavity placed at an appropriate angle with respect to said tenon whereby said concavity receives said second armature when said wiper means is rotated to an obtuse rotational position.

13. An adaptable rotary power control switch as recited in claim 1 wherein said contact means comprises a first armature and a second armature, and wherein said chosen shaft-actuator assembly is a three-way rotary control comprising:

a shaft with upper and lower portions, said shaft having a longitudinal groove in said upper portion for mating with said wiper means;

a flange integral with said shaft located near the center of said shaft;

a first simple actuator integral with said shaft located between said flange and said lower portion of said shaft, said first simple actuator placed at an appropriate angle with respect to said longitudinal groove whereby said first simple actuator pushes against said first armature when said wiper means is rotated to an acute rotational position; and a second simple actuator integral with said shaft located between said first simple actuator and said lower portion of said shaft, said second simple actuator placed at an appropriate angle with respect to said first simple actuator whereby said second simple actuator pushes said second armature when said wiper means is rotated to an obtuse rotational position.

14. A family of power control switches having rotary motion for variable control of an electronic circuit, said family of said power control switches comprising:

a switch housing having an open side;

rotary shaft means rotatably anchored on a first end inside said switch housing, a second end of said rotary shaft means extending out said open side of said switching housing;

a circuit board having most of said electronic circuit thereon resting on abutting means inside said switch housing, said circuit board being generally parallel to said open side of said switch housing;

wiper means carried by said rotary shaft means for electrically contacting variable resistance means of said electronic circuit to give variable resistance as said rotary shaft means rotates, said variable resistance means being on said circuit board;

strap means covering said open side of said switch housing, said strap means having an opening for said second end of said rotary shaft means to extend therethrough said strap means continually urging said wiper means against said circuit board for electrically contacting said variable resistance means by said wiper means and holding said circuit board against said abutting means, said rotary shaft means having a flange larger than said opening in said strap means, said strap means providing a heat sink for said electronic circuit;

contact means connected to said circuit board; and armature means actuated by initial rotary motion of said rotary shaft means to electrically connect through said contact means to allow said variable control by said electronic circuit.

15. A family of power control switches as recited in claim 14, said switch housing comprising:

an interior floor and four side walls;

attachment means for securing said strap means to said switch housing;

peg means for attachment of said armature means to said switch housing;

anchor means for rotatably attaching said first end of said rotary shaft means to said switch housing; and said switch housing having at least one exit hole for power supply wires.

16. A family of power control switches as recited in claim 15, said anchor means comprising:

a spline cylinder integral with and perpendicular to said interior floor of said switch housing; and a reset gear integral with said interior floor of said switch housing and surrounding said spline cylinder.

17. A switch housing for containing mechanical and electrical elements of a power control switch, said switch housing comprising:

a floor with an interior surface;

four side walls integral with and perpendicular to said interior surface;

a spline cylinder attached and perpendicular to said interior surface of said floor; and a reset gear attached to said interior surface to said floor and surrounding said spline cylinder.

18. A switch housing as recited in claim 17 further comprising:

a plurality of pegs for attaching an armature to said switch housing; and a peg surface parallel to and raised above said interior surface of said floor, said pegs mounted perpendicular to said peg surface.

19. A switch housing as recited in claim 18 further comprising:

a plurality of support members perpendicular to said floor and integral with said side walls, for supporting a planar board;

at least one tab integral with one of said side walls extending away from the center of said switch housing, for securing a strap to cover said switch housing and for mounting said switch housing to an exteral surface; and said switch housing having an exit hole for power supply wires.

20. A push-push actuator for advancing any rotor mechanism, comprising:

a fixed spline cylinder having upper and lower portions;

a lower reset gear integral with and surrounding said lower portion of said spline cylinder;

a hollow, cylindrical rotor having an upper end and a lower end, and having at said lower end an upper reset gear for meshing with said lower reset gear, said rotor surrounding said spline cylinder;

a circular indexing gear for indexing said rotor, having upper and lower ends, and having a central spline shaft for mating with said spline cylinder;

a spring for displacing said indexing gear away from said push-push actuator; and a control shaft for actuating said indexing gear.

21. A push-push actuator as recited in claim 20 wherein:

said control shaft has at one end a flange integral therewith which tapers away from said control shaft ending in an alignment pin;

said indexing gear has at said upper end a concave seat and aperture for mating with said tapered flange and alignment pin, and said indexing gear also has at said lower end upper indexing teeth; and said rotor has therein lower indexing teeth for meshing with said upper indexing teeth.

22. A power control switch kit capable of being assembled with any one of a chosen variety of shaft-actuator assemblies comprising:

a chosen one of said variety of shaft-actuator assemblies having upper and lower portions;

a switch housing, said switch housing comprising a floor with an interior surface, side walls, and anchor means attached to said interior surface adapted to receive said lower portion of said chosen one of said variety of shaft-actuator assemblies when said kit is assembled;

a circuit board adapted to be fitted inside said switch housing, said circuit board having an aperture adapted to allow passage of said upper portion of said chosen one of said variety of shaft-actuator assemblies, when said kit is assembled, said circuit board further having a contact means attached thereto whereby when said kit is assembled rotation of said one of said variety of shaft-actuator assemblies and said contact means cause electricity to flow from a power source through circuitry of said circuit board;

a wiper shoe adapted to be positioned adjacent to said circuit board, said wiper shoe having an aperture adapted to allow passage of said upper portion of said chosen one of said variety of shaft-actuator assemblies and having a wiper member engaging conductive paths on said circuit board when said kit is assembled; and a planar strap having an aperture therein adapted to allow passage of said upper portion of said chosen one of said variety of shaft-actuator assemblies and affixable over said switch housing for retaining said chosen one of said variety of shaft-actuator assemblies, said circuit board, and said wiper shoe within said switch housing when said kit is assembled.

23. The kit of claim 22, further comprising a control knob adapted to be received on said upper portion of said chosen one of said variety of shaft-actuator assemblies when said kit is assembled.

24. The kit of claim 22 wherein said anchor means further comprises:

a spline cylinder attached and perpendicular to said interior surface of said floor; and a reset gear attached to said interior surface of said floor and surrounding said spline cylinder.

25. The kit of claim 22 wherein said anchor means further comprises:

a spline cylinder attached and perpendicular to said interior surface of said floor; and a reset gear attached to said interior surface of said floor and surrounding said spline cylinder.

* * * * *